US012618236B2

(12) United States Patent
Thompson

(10) Patent No.: US 12,618,236 B2
(45) Date of Patent: May 5, 2026

(54) LIGHTING MAINTENANCE SYSTEM

(71) Applicant: Dwayne Thompson, Charlotte, NC (US)

(72) Inventor: Dwayne Thompson, Charlotte, NC (US)

( * ) Notice: Subject to any disclaimer, the term of this patent is extended or adjusted under 35 U.S.C. 154(b) by 190 days.

(21) Appl. No.: 18/218,709

(22) Filed: Jul. 6, 2023

(65) Prior Publication Data

US 2025/0012077 A1 Jan. 9, 2025

(51) Int. Cl.
*E04B 9/00* (2006.01)
*E04B 9/20* (2006.01)

(52) U.S. Cl.
CPC ..... *E04B 9/006* (2013.01); *E04B 9/003* (2013.01); *E04B 9/20* (2013.01)

(58) Field of Classification Search
CPC ..... E04B 9/006; E04B 9/003; E04B 9/20
USPC ..... 52/506.06, 220.1, 220.6
See application file for complete search history.

(56) References Cited

U.S. PATENT DOCUMENTS 4,006,567 A * 2/1977 Flannery ..... E04B 9/00 52/39
4,835,914 A * 6/1989 Scherrer ..... E04B 9/303 52/63
5,479,326 A * 12/1995 Nilssen ..... H02H 3/021 362/225
5,640,069 A * 6/1997 Nilssen ..... H05B 41/28 315/219
5,738,436 A * 4/1998 Cummings ..... F21V 25/00 362/148
6,260,981 B1 * 7/2001 Fiene ..... F21V 19/0095 362/147
6,439,736 B1 * 8/2002 Fiene ..... F21V 23/06 362/147
6,508,567 B1 * 1/2003 Fiene ..... F21V 3/00 362/147
6,860,617 B2 * 3/2005 Fiene ..... F21S 2/00 362/147
2010/0328853 A1 * 12/2010 Johnson ..... H02G 3/38 361/641
2013/0014985 A1 * 1/2013 Ferrara ..... H02G 11/02 174/491
2013/0182416 A1 * 7/2013 Wilson ..... F21S 8/04 362/147

* cited by examiner

*Primary Examiner* — Brent W Herring
(74) *Attorney, Agent, or Firm* — Lyman Moulton, Esq.; Moulton Patents, PLLC

(57) ABSTRACT

The Thompson Lighting System is the only product of its kind that reduces the risk of falls and other hazards associated with light maintenance performed on fixtures placed in high ceiling locales. This unprecedented product is uniquely designed to be universal and therefore allows users to attach the apparatus onto any brand or manufacturer of high bay lights. Moreover, the system offers versatility and compatibility with a wide range of lighting systems, making it a valuable solution for a broad range of businesses.

10 Claims, 1 Drawing Sheet

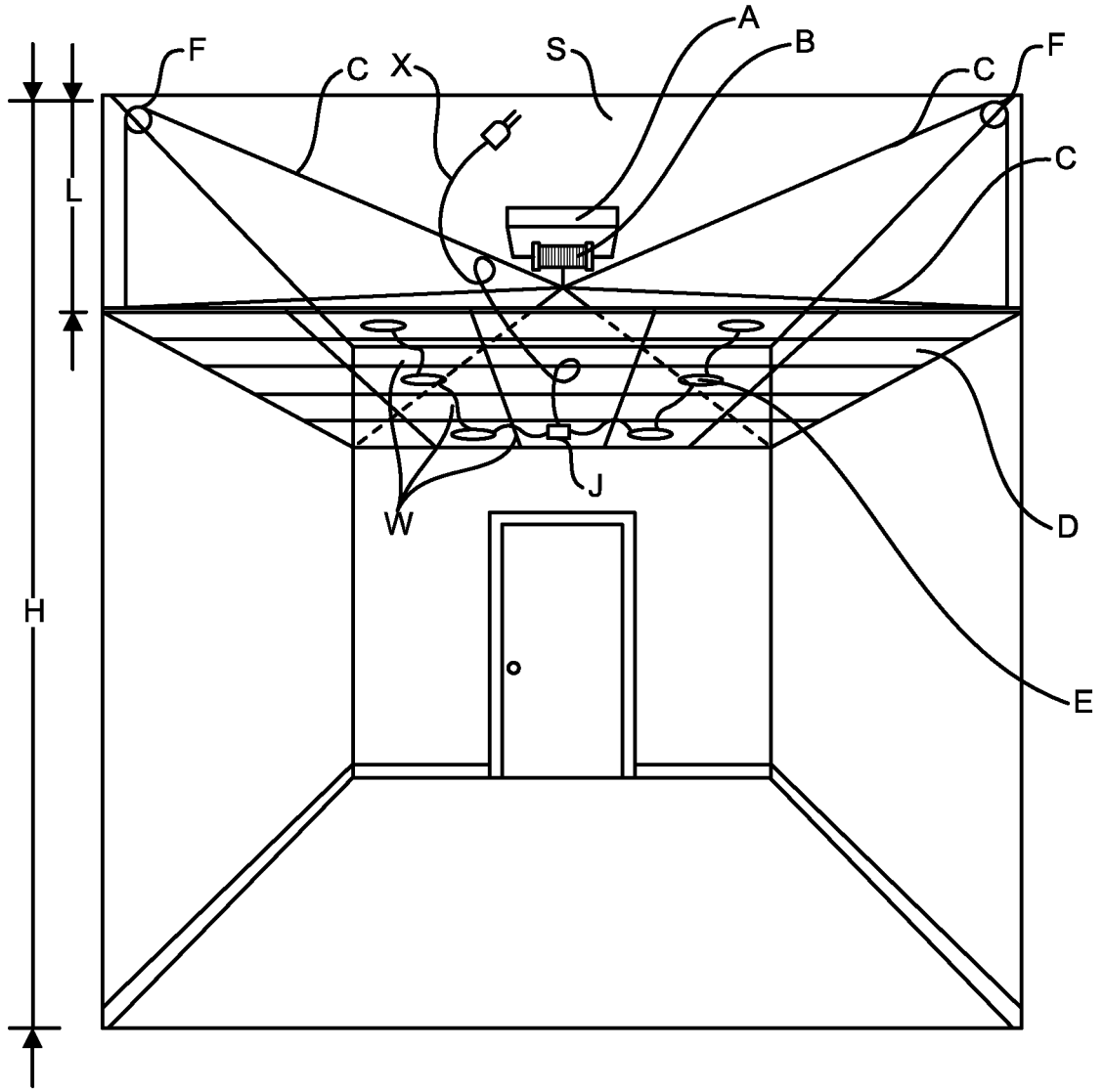
A
B
S
F
C
X
C
F
C
L
J
W
D
H
E

LIGHTING MAINTENANCE SYSTEM

BACKGROUND

When it comes to the maintenance of elaborate light fixtures, most companies must ensure scheduled routine assessments of their lighting which can be incredibly time consuming and labor intensive. Professionals often have to use ladders or mechanical lifts to access these lights and their power lines which can be a dangerous endeavor. There have been no products available as original equipment or as an aftermarket to address this problem.

An apparatus to simplify and create a safer way to carry out routine assessments and maintenance of lighting, is not being met by any known device or system at present. There have been no products available as original equipment or as an aftermarket to address this problem either.

SUMMARY OF THE INVENTION

The main purpose the lighting maintenance system is to provide users with a method of controlling light fixtures positioned in the ceiling of higher buildings, such as: cathedral ceilings, high warehouse ceilings, or any other open area/high rise building.

BRIEF DESCRIPTION OF THE DRAWINGS

FIG. 1 is a front perspective view of the lighting maintenance system in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1 is a front perspective view of the lighting maintenance system showing: motor referenced as A, pulley referenced as B, cables referenced as C, motorized drop ceiling referenced as D, lighting fixtures referenced as E, in accordance with an embodiment of the present disclosure. The view also includes the pulley wheels F for each corner of the drop ceiling D, the electrical extension cord X from the junction box J and the electrical wires W. The drop ceiling is suspended a length L from the structural ceiling S which is a height H from the floor of the structure. The extension cord X can be twisted and cabled with the main cable or it can be coiled and loose between the structural ceiling S and the drop ceiling D. The motor A is remote controlled to allow for high ceiling maintenance but is optional to a draw cable operated manually where electricity is limited or in emergency situations.

The present disclosed lighting maintenance system, also known as "Thompson Lighting System", offers a modern alternative to managing lighting maintenance that not only improves the efficiency of the process but also enhances the safety of the workers performing the maintenance. The Thompson Lighting System introduces a novel central station that lowers the lights down to a safer level for routing maintenance via an aircraft cable and a wire harness able to move from ground level and up, as needed, to make the operation faster, more efficient, economical, and much safer. Once the operation is complete, the lights can be easily raised back to their normal operating position to provide the aesthetic benefit of higher lights. This innovative, top-quality system can have a positive impact on the health and well-being of electricians, professionals and laymen, alike, as they access ornate lighting systems designed for higher placement.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A lighting maintenance system comprising:

a drop ceiling configured underneath a structural ceiling by a drop length and comprising an electrical lighting;

a cable network attached to the drop ceiling configured to suspend the drop ceiling from the structural ceiling from a main cable having a length greater than the drop length;

an electrical extension cord longer than the length of the main cable and configured to service the electrical lighting; and a pulley configured to extend the main cable and lower the drop ceiling and retract the main cable and raise the drop ceiling, wherein the cable network creates a center of balance for the drop ceiling at the main cable.

2. The lighting maintenance system of claim 1, further comprising a motor configured to drive the pulley to lower and raise the drop ceiling.

3. The lighting maintenance system of claim 1, wherein the cable network comprises cables attached to a plurality of points on the drop ceiling.

4. The lighting maintenance system of claim 1, further comprising a remote control of a motor configured to drive the pulley.

5. The lighting maintenance system of claim 1, further comprising a junction box for a connection of the electrical extension cord with the electrical lighting.

6. The lighting maintenance system of claim 1, further comprising an electrical supply network configured to service the electrical lighting from a junction box adjacent the drop ceiling.

7. The lighting maintenance system of claim 1, wherein the pulley is disposed adjacent the structural ceiling.

8. The lighting maintenance system of claim 1, wherein the pulley is disposed adjacent the drop ceiling.

9. The lighting maintenance system of claim 1, wherein the length of the main cable is equal to a height of the structural ceiling from a floor of the structure.

10. The lighting maintenance system of claim 1, further comprising a cable wheel for each of four corners of the drop ceiling.

* * * * *